United States Patent [19]

Hosaka et al.

[11] 4,125,889

[45] Nov. 14, 1978

[54] TRANSPORTATION ARRANGEMENT WITH SPOTLIGHT PROJECTORS FOR ILLUMINATING TRUNNIONS OF A MOLTEN IRON LADLE

[75] Inventors: Yukio Hosaka; Kunio Matsui, both of Fukuyama; Tomio Yamamoto, Takamatsu, all of Japan

[73] Assignees: Nippon Kokan Kabushiki Kaisha, Tokyo; Fuji Toyuki Kabushiki Kaisha, Takamatso, both of Japan

[21] Appl. No.: 708,350

[22] Filed: Jul. 26, 1976

[30] Foreign Application Priority Data

Jul. 30, 1975 [JP] Japan ..... 50-92106

[51] Int. Cl.[2] ..... F21V 33/00

[52] U.S. Cl. ..... 362/253; 362/293; 212/13; 212/130

[58] Field of Search ..... 240/11.4, 41, 41.3, 240/41.35, 41.6, 44, 46.59, 51.11, DIG. 5; 362/234, 253, 293, 307, 311, 257, 231; 212/11, 13, 14, 130

[56] References Cited

U.S. PATENT DOCUMENTS

| | | | |
|---|---|---|---|
| 1,018,143 | 2/1912 | Vissering | 240/DIG. 5 |
| 1,157,966 | 10/1915 | Standerwick | 240/DIG. 5 |
| 3,689,761 | 9/1972 | Rosen et al. | 240/41.3 |
| 3,737,653 | 6/1973 | Biggs et al. | 240/41.3 |
| 3,803,400 | 4/1974 | Ozawa | 240/41.6 |
| 3,922,085 | 11/1975 | Sheets | 240/41.3 |

*Primary Examiner*—Richard A. Wintercorn
*Assistant Examiner*—Alan Mathews
*Attorney, Agent, or Firm*—Haseltine, Lake & Waters

[57] ABSTRACT

A transportation arrangement with spotlight projectors for illuminating the trunnions of a molten iron ladle for viewing by an operator when engaging a hoisting hook with the trunnion of the ladle. A spotlight projector employs a very high pressure mercury lamp as a light source and the beam of light from this light source is projected in the form of a bundle of parallel light rays of specific wavelengths through a collimator lens system. This system employs an elliptic reflecting mirror, a slit, a filter for transmitting specific wavelengths and a convex lens. The projected bundle of parallel light rays consists of a group of green and yellow bright-line spectra having a center wavelength of 5,000 Å. The projector is designed to be mounted on an overhead travelling crane and its projection optical axis is adjustable.

2 Claims, 10 Drawing Figures

TRANSPORTATION ARRANGEMENT WITH SPOTLIGHT PROJECTORS FOR ILLUMINATING TRUNNIONS OF A MOLTEN IRON LADLE

BACKGROUND OF THE INVENTION

The present invention relates to a spotlight projector for overhead travelling cranes which employs a very high pressure mercury lamp as its light source and is mounted on an overhead travelling crane to spotlight a lifting device.

Generally, when an overhead travelling crane is operated, it is an essential operating requirement for the operator of the overhead travelling crane to ascertain an object to be lifted or the engagement of the object with the lifting device by viewing or visual observation. Particularly, in the case of large cranes, the importance of this problem is further increased by the special uses of these cranes. For instance, in the case of a so-called ladle crane having a large capacity as compared with those of other cranes used in an iron works, the crane is used to carry the molten iron to and away from the mixer, or carry the molten iron to the open-hearth furnace and carry away the molten steel from the open-hearth furnace and its capacity in terms of the total weight, i.e., the sum of the weight of the ladle and the weight of its content is far in excess of 200 tons. Moreover, there are many cases where the overhead travelling crane is used continuously day and night and thus there are instances where satisfactory accomplishment of the previously mentioned essential operating requirement is made extremely difficult depending on the type of objects to be lifted, the conditions of the working environment, etc.

For instance, when a molten iron charging ladle is to be lifted in an iron works or the like where the crane is continuously operated day and night as mentioned previously, the operator of the crane frequently experiences that the operator is blinded by the radiant light rays of a high relative brightness emitted from the surface of the molten iron in the molten iron ladle and the operator finds it extremely difficult to ascertain by visual observation the lifting device as well as the surrounding objects other than the molten iron ladle itself. Particularly, during the crane operation for bringing the hoisting hooks from the traversing car near the trunnions on the molten iron ladle or the operation of engaging the hooks with the trunnions, it is extremely difficult for the operator to check up the hooks and the trunnions through visual observation and this presents an operating difficulty. In particular, during the night operation, the operating difficulties due to such causes tend to become increasingly serious considerably with the result that not only these problems involve the possibility of causing serious error or accidents but also they must be studied from the standpoint of safety supervision.

Although an attempt has been made to overcome the foregoing difficulties by providing large projectors in the work site to illuminate the important places, the foregoing operating difficulties have not be overcome completely.

SUMMARY OF THE INVENTION

It is therefore an object of this invention to provide a spotlight projector for an overhead travelling crane which is capable of providing a spotlight that produces satisfactory working conditions for raising and moving by a crane of an object including a source of radiant light such as a molten iron ladle.

It is another object of this invention to provide a spotlight projector for an overhead travelling crane which employs a very high pressure mercury lamp as a light source and those rays of specific wavelengths in the beam of light from the very high pressure mercury lamp are transmitted and projected.

It is a further object of this invention to provide a spotlihgt projector which employs a very high pressure mercury lamp as a light source and the beam of light from the light source is projected while obstructing those light rays present in the near ultraviolet wavelength region.

It is still further object of this invention to provide a spotlight projector for an overhead travelling crane in which of the beam of light from a light source consisting of a very high pressure mercury lamp, the beam of light rays consisting of a group of the green and yellow bright-line spectra having a center wavelength of 5,500 Å is projected.

It is still further object of this invention to provide a spotlight projector for an overhead travelling crane which is capable of intensively projecting a beam of parallel light rays in a specific wavelength range onto the desired work position of an object to be lifted where a hoisting hook is engaged with the object.

It is still further object of this invention to provide an improved construction of a spotlight projector of the type mounted on an overhead travelling crane which permits intensive illumination of the desired work position with a beam of parallel light rays in a specific wavelength range.

DESCRIPTION OF THE PREFERRED EMBODIMENT

Figure 1:
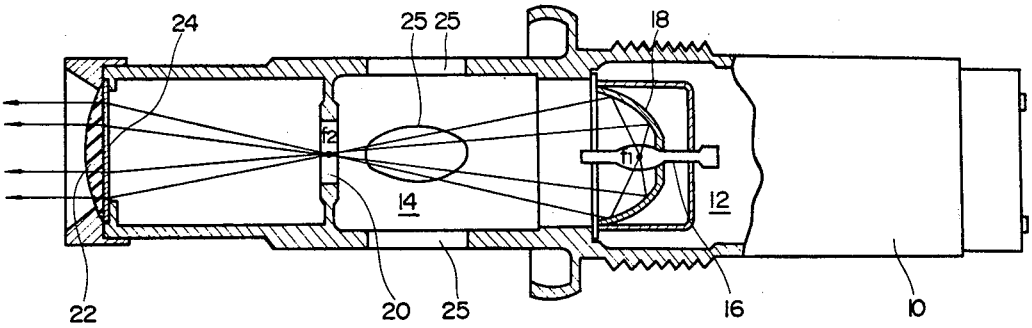
FIG. 1 is a sectional view of a spotlight projector embodying the present invention and incorporating a very high pressure mercury lamp and a collimator lens system.

Referring to the drawings, FIG. 1 illustrates in section an embodiment of a spotlight projector according to the invention. In the Figure, a projector proper 10 is divided into two principal parts, a lamp housing 12 and a lens barrel portion 14. Accommodated within the lamp housing 12 are a very high pressure mercury lamp 16 constituting a light source and an elliptic reflecting mirror 18 disposed to enclose the light source and having an open forward end, and the very high pressure mercury lamp 16 constituting a light source is positioned at one focal point $f_1$ of the elliptic reflecting mirror 18 so that the light rays emitted from the light source are converged by the elliptic reflecting mirror 18 at its other focal point $f_2$ in a slit 20.

On the other hand, the lens barrel portion 14 consists of a cylinder having the slit 20 formed in the central portion thereof, and it includes a convex lens 22 mounted at the cylinder forward end and a Y-type 48 optical filter 24 positioned in the rear of the convex lens 22. The convex lens 22 is arranged so that its focal point is located in the central portion of the slit 20. Thus, the light rays emitted from the light source are converged through the elliptic reflecting mirror 18 at a point in the central portion of the slit 20 and the light is then projected in parallel rays through the convex lens 22 having its focal point $f_2$ located in the central portion of the slit 20. Therefore, the slit 20 and the convex lens 22 having its focal point $f_2$ located in the central portion of the former constitute a collimator.

Thus, since the beam of light that will be transmitted through the convex lens 22 has its near ultraviolet rays absorbed and filtered out when it passes through the optical filter 24, the parallel rays passed through the convex lens 22 constituting part of the collimator are projected in the form of a light comprising mainly of green and yellow colors and existing in the wavelength range which ensures the most desirable luminosity. An opening 25 formed in the peripheral wall of the lamp housing 12 is an exhaust port for discharging the heated atmosphere of the mercury lamp 16 to the outside.

The beam of light rays in a specific wavelength range which is projected from the spotlight projector of this invention will now be described.

Figure 2A:
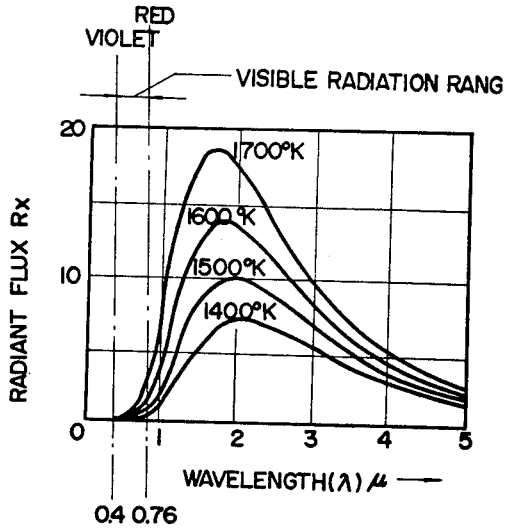
FIG. 2A is a diagram showing continuous spectral radiation curves for the temperature radiation from a molten iron.
Figure 2B:
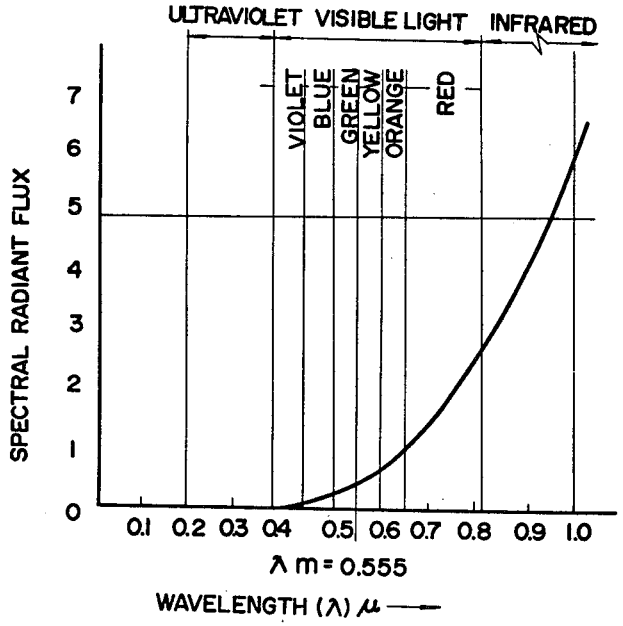
FIG. 2B is a spectral radiation curve corresponding to the spectral radiation curve of FIG. 2A in the visible radiation range.

The spectral radiant flux radiated from the surface of red hot molten iron will be considered first. Assuming that the temperature of the molten iron is 1,430° C. (1,700° K. in terms of absolute temperature), regarding the radiation as the temperature radiation of a solid or liquid, in accordance with the Stefan-Boltzmann law,, Planck radiation equation or the Wien displacement law the spectral wavelength $\lambda_m$ at which the maximum radiant flux occurs is given as 1.70$\mu$ (or 17,000A) which is present in the infrared region and the spectral radiation curves shown in FIG. 2A result. If the wavelength range is limited to the visible light region ranging from 0.81 to 0.38$\mu$ and the radiation is considered as the temperature emission, the spectral radiant flux curve as shown in FIG. 2B is obtained.

Figure 3A:
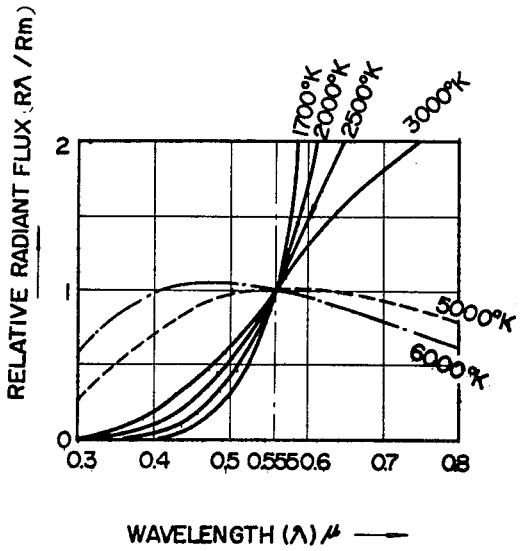
FIG. 3A is a diagram showing the relative radiant flux curves corresponding to the spectral radiation curves of FIG. 2A with the spectral radiant flux at the wavelength $\lambda_m$ ($\lambda_m = 0.555\mu$) of the maximum luminosity or visibility being taken as 1.
Figure 3B:
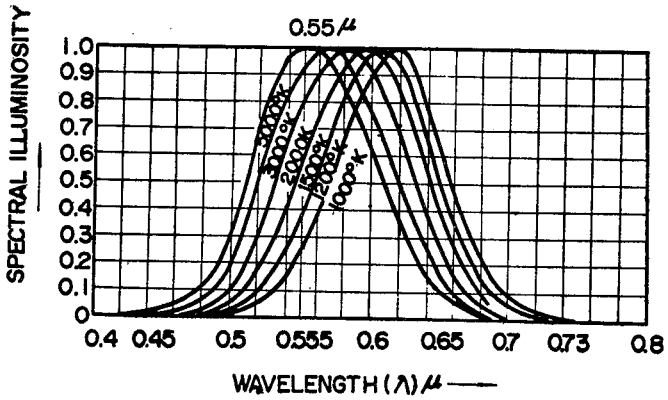
FIG. 3B is a diagram showing the spectral illuminosity curves corresponding to the relative radiant flux curves of FIG. 3A.

For purposes of comparison, if the temperature of the radiator is varied and spectral distribution curves are obtained by taking the spectral radiant flux at a wavelength of 0.560$\mu$ as 1, the spectral radiation curves as shown in FIG. 3A result. Since the luminosity is maximum for the light of wavelengths between 0.555 and 0.560$\mu$, if this is taken as 1, the luminosities at other wavelengths may be given in terms of relative luminosities. The curve shown at the temperature of 1,700° K. corresponds to the previously mentioned molten iron temperature (1,430° C.) and it shows the spectral radiant light beam characteristic of the radiant light beam from the molten iron surface, the curves shown at 2,500° to 3,000° K represent the radiant light beam characteristics of an ordinary gas-filled tungsten-filament lamp, and the curve shown at 6,000° K. represents practically the spectral characteristic of the light beam radiant from the surface of the sun. It will be seen from these curves that at the temperatures of 1,700°, 2,000°, 2,500° and 3,000° K. the radiant flux increases as the wavelength of the spectrum increases (toward the red region) and it decreases as the wavelength decreases (toward the violet region), whereas at the temperature of 6,000° K. the radiant flux conversely decreases as the wavelength increases and it increases as the wavelength decreases. This indicates that the molten iron ladle (the radiation temperature is 1,700° K.) and the incandescent lamp (the radiation temperature is between 2,500° and 3,000° K.) merely differ from each other in terms of the wavelength $\lambda_m$ of the maximum radiant flux $R_m$ and they are the same with each other in that the red color ($\lambda$ = 0.64 to 0.76$\mu$) is very strong in the wavelength range ($\lambda$ = 0.4 to 0.76$\mu$) of the visible light. On the contrary, at the temperatures near above 5,000° K. the distribution of the radiant flux is practically uniform, while at the temperatures between 6,000° and 6,500° K. the radiant flux increases as the wavelength decreases and it decreases as the wavelength increases thus radiating light beam which is white in color. In other words, it is the same as the sun light. These relations are shown by the spectral illuminosity curves of FIG. 3B.

In view of these facts, if a molten iron ladle and its surroundings are illuminated by a spotlight projector employing an incandescent lamp as a light source, part of the incident light rays are absorbed and the remainder is reflected with the result that the beam of light rays with practically the same color tone is continuously radiated from the surface of the molten iron and the radiation only slightly increases the illuminosity. Consequently, it is apparent that there is no improvement in the background conditions for the surroundings of the molten iron ladle in respect of the relative visual sensation and the irradiation and it is still difficult to ascertain or distinguish the surroundings of the molten iron by visual observation. The fact that relatively good results are obtainable during the daytime than in the night is attributable for the most part to the utilization of natural lighting with the sunlight. Since, as mentioned previously as shown in FIGS. 3A and 3B, the temperature radiation at 6,000° K. produces white light according to the spectral illuminosity curve centering around the wavelength of maximum relative luminosity of 0.555$\mu$ and thus the red spectrum is not intensified as in the case of an incandescent lamp, it is possible to easily distinguish the molten iron ladle from the surrounding objects.

Figure 4:
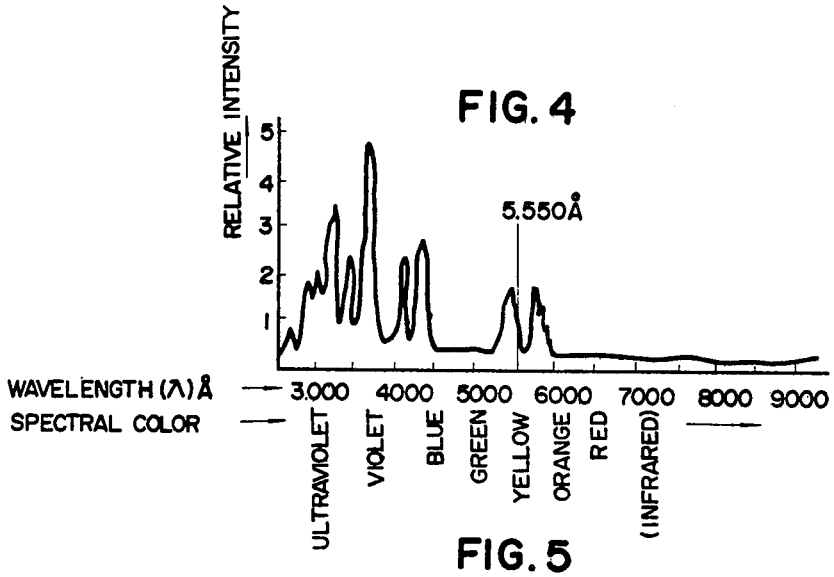
FIG. 4 is a diagram showing the distribution in different wavelengths ($\lambda$) of the energy in the bright-line spectrum of the very high pressure mercury lamp used in the projector according to the invention.

The present invention stems from the recognition of this fact and it adopts a new system in which instead of illuminating an object with a conventional projector, of the beam of light from a very high pressure mercury lamp only those rays of specific wavelengths are transmitted and projected. The fact that the use of such very high pressure mercury lamp as a light source is extremely advantageous in accomplishing the objects of this invention will now be described in great detail with reference to FIGS. 4 and 5. Differring from the continuous spectrum of the temperature radiation from a solid or liquid of the type mentioned previously, the radiant light beam from such light source consists of a group of bright-line spectra. FIG. 4 is a spectral distribution diagram showing the relative intensity in different wavelengths of the energy of the group of the bright-line spectra of the very high pressure mercury lamp. As will be seen from the Figure, there is a group of very strong bright line spectra in the vicinity of the wavelengths between 3,000 and 4,000 Å and these line spectra are composed of near ultraviolet rays. Also, with the spectral colors, the existence of any noticeable bright line spectra is not seen in the wavelength range from the red to the infrared region.

However, the Figure shows that there exists between the above-mentioned near ultraviolet wavelength region and the near infrared wavelength region a group of the strong bright spectra of the intermediate wavelength range extending from 4,500 to 6,000 Å and including the center spectrum having a wavelength of the maximum luminosity of 5,550 Å (0.555μ) and it is possible to utilize this group of the line spectra. In the intermediate wavelength range, it will be seen that in terms of the colors, the presence of the radiant flux is very eminent in the green region (4,920 to 5,500 Å) and the yellow region (5,500 to 5,900 A) and practically no radiant flux is present in the blue region (4,500 to 4,900 Å) and the orange region (5,900 to 6,400 Å) which are on both sides of the green and yellow regions. As a result, in the light of the objects of this invention the near ultraviolet rays having the wavelengths shorter than 4,500 Å and part of the blue color are filtered out by a filter which will be described later and the radiant light beam including a large amount of the green and yellow spectral colors centering around that spectrum which is most sensible to the eye or the spectrum having a wavelength of 5,550 Å at which the relative luminosity V λ is maximum. By focussing the light beam composed of the spectra of such specific wavelengths into parallel light rays through a collimator lens system and spotlighting with the parallel light rays the mechanism for engaging the trunnion of a molten iron ladle with the hoisting hook of an overhead travelling crane, it is possible to illuminate the principal parts of the hoisting engagement mechanism with the spectral light beam of the maximum luminosity so as to ensure easy ascertainment or distinction by visual observation and at the same time the function and effect of the spotlight projector are coupled with the operating function of the overhead travelling crane. The previously mentioned filter may for example be a Y-48 which is particularly selected for the present purpose from among Y-44, Y-46, Y-48, Y-50 and Y-52 which are specified by JIS B713 in the light of the objects of this invention, and FIG. 5 shows the relation between the wavelength λ of the different light beam spectra and the transmittance (%) of the filters.

Figure 5:
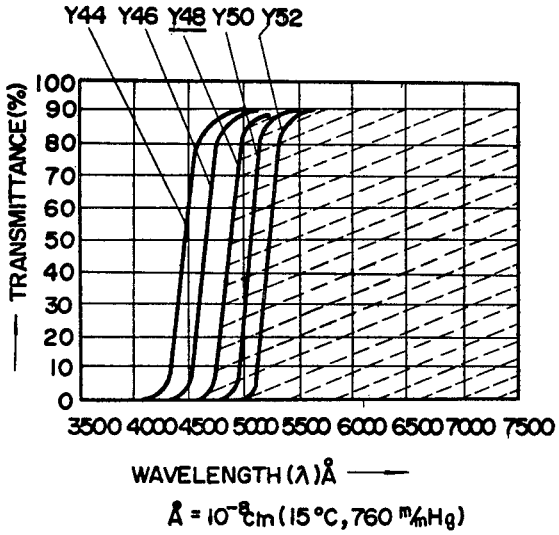
FIG. 5 is a wavelength characteristic diagram showing the transmittance of the optical filter used in the projector of this invention.

It will be seen from FIG. 5 that the light beam spectra of the wavelength regions belonging to the hatched portion and longer than 4,500 Å are permitted to pass and the passage of the remaining light beam having the wavelengths in the near ultraviolet region is obstructed. On the other hand, the relative intensity of the light beam spectra of the wavelengths in the near infrared region is so low that they can be considered to be practically non-existing and consequently no means is required to eliminate them. Thus, in accordance with the present invention, of the light beam consisting of discontinuous spectra as shown in FIG. 4 the undesired light beam of the wavelengths shorter than 4,500 Å are filtered out by an optical filter of the type illustrated in FIG. 5 and the light beam of the yellow and green regions centering around the wavelength of the maximum luminosity of 5,500 Å are utilized to spotlight the principal parts of the hoisting mechanism of a molten iron ladle thus ensuring an improved relative luminosity of these parts.

Referring again to FIG. 1, the very high pressure mercury lamp 16 which is utilized as a light source is of the type in which the mercury vapor pressure is made greater than that of the ordinary high pressure mercury lamp and it uses a quartz tube or electrodes made from such oxide as CD. With this very high pressure mercury lamp, the luminance increases as the vapor pressure increases and also the distribution of the bright-line spectra in its radiant light beam is a feature of this mercury lamp, although the lack of red color is considered as a disadvantage by some people. With the present invention however, it is evident from the foregoing description that the lack of this color is utilized as the most important merit. In the present invention, the very high pressure mercury lamp 16 is of the commercially available 220 V, 250 watt capacity and it is shaped into a very small size, thus making it very useful as a light source for the spotlight projector of this invention.

Figure 6:
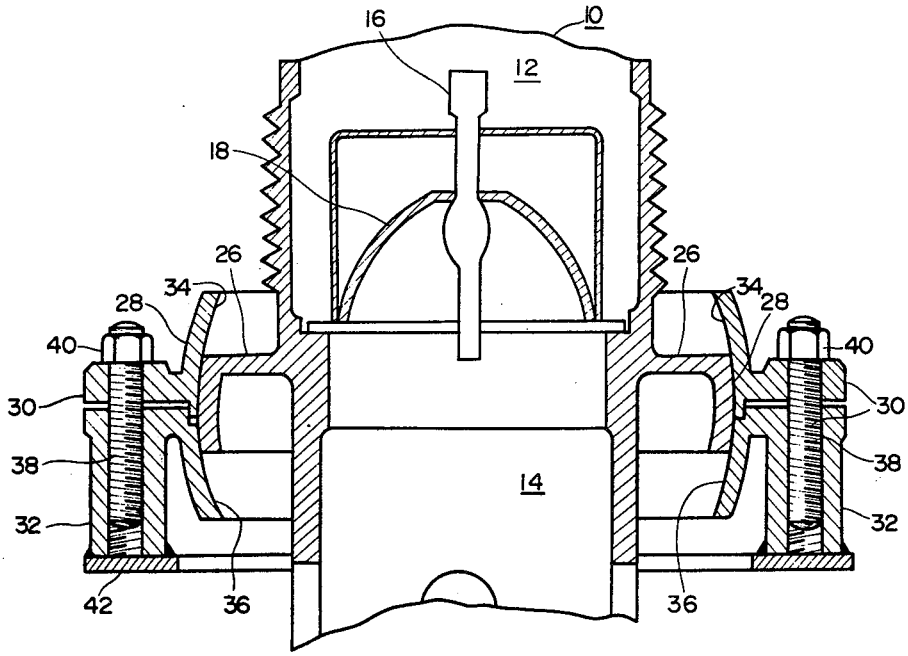
FIG. 6 is a sectional view of the mechanism for adjusting the angle of the optical axis of the projector of this invention.

FIG. 6 illustrates in section a structure for mounting the spotlight projector of this invention on an overhead travelling crane and for directing the projected light rays toward the target object. A collar 26 with a spherical seat 28 is formed on practically the central portion of the projector 10. Bearing members 30 and 32 are provided to embrace the spherical seat 28, with the inner side of the bearing member 30 including a concave spherical seat 34 and the bearing member 32 also including a similar concave spherical seat 36. The bearing members 30 and 32 are fastened together by means of stud bolts 38 and nuts 40 and a mounting support 42 is attached to the bottom side of the bearing member 32. The spotlight projector of this invention may be mounted on the overhead travelling crane by attaching the mounting support 42 to a suitable place of the crane by welding, for example. The direction of projection of the projector 10 is adjustable by loosening the nuts 40 and thereby unfastening the bearing members 30 and 32 and in this way the angle of the optical axis of the projector 10 is freely adjustable through the sliding motion between the spherical seat 28 and the spherical seats 34 and 36.

An exemplary use application of spotlight projectors of the type constructed as described above and mounted on an overhead travelling crane will now be described with reference to FIGS. 7 and 8.

Figure 7:
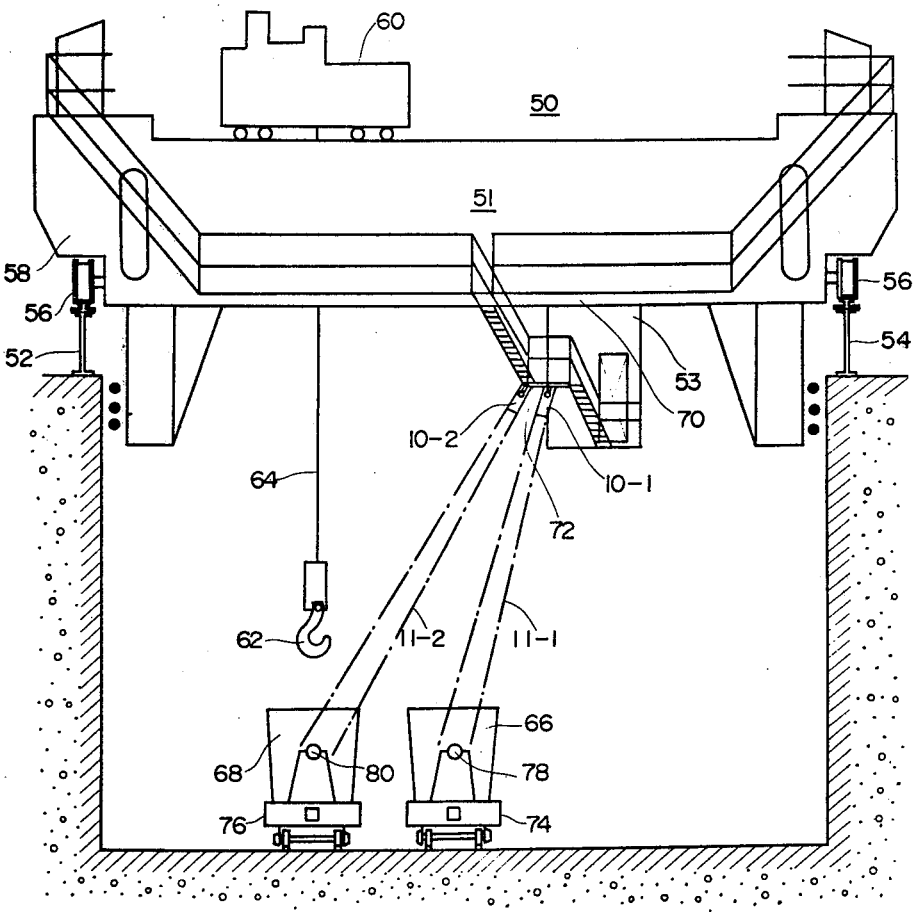
FIG. 7 is a perspective view of an overhead travelling crane equipped with the projectors according to the invention and designed for lifting the molten iron ladles mounted on ladle cars.
Figure 8:
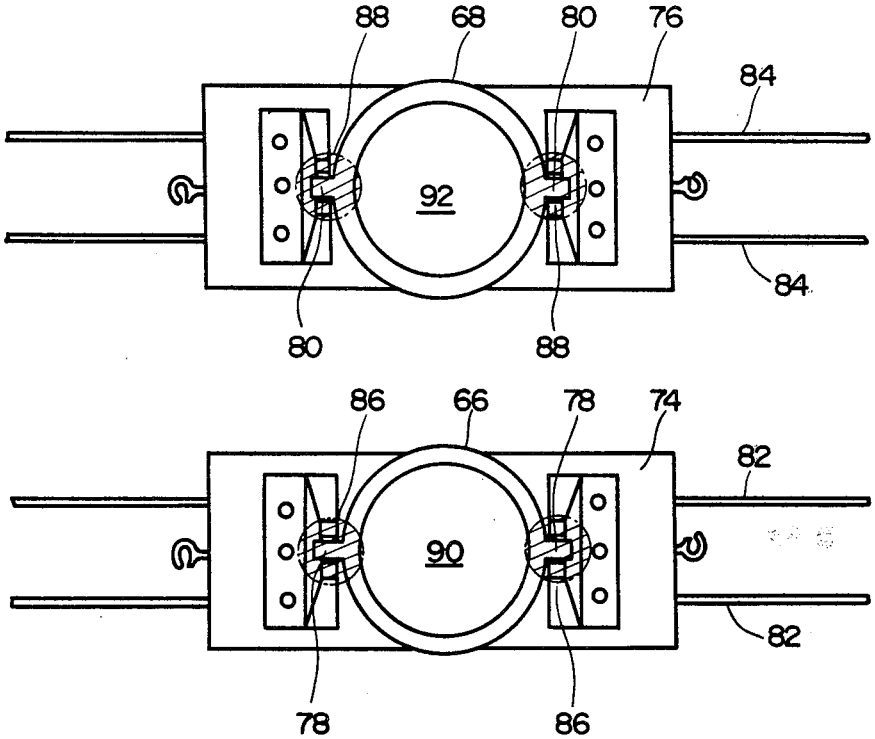
FIG. 8 is a plane view of the molten iron ladles on the ladle cars which are to be lifted, as viewed from the craneman's house and showing the illuminated positions by the projectors according to the invention.

In FIG. 7 illustrating an explanatory side view of an overhead travelling crane 50 for lifting molten iron ladles of 280 ton capacity, the crane 50 includes a transfer car 58 which is composed of two bridge girders 51 arranged perpendicular to two rails 52 and 54 arranged on the ceiling of a steel mill to extend in the lengthwise direction of the building and the ends of the bridge girders 51 are supported on two steel saddles each having two to four flanged wheels 56. The transfer car 58 is adapted to run on the rails 52 and 54 and a traverse car 60 having a hoisting device mounted thereon is adapted to run on the separately arrange rails on the two bridge girders 51.

The crane 50 is equipped with spotlight projectors 10-1 and 10-2 each employing as its light source a very high pressure mercury lamp of the previously mentioned type and thus the projectors are moved in response to the operation of the crane 50 so as to spotlight the hoisting joint portions and the surroundings. A craneman's house 53 is provided in the lower part of the crane 50. In addition to the hoisting device, the traverse car 60 includes hoisting hooks 62 which are suspended from hoisting wires 64. The crane 50 is used to lift and move molten iron ladles 66 and 68 which are filled with molten iron.

In the Figure, numeral 70 designates a passageway and the spotlight projectors 10-1 and 10-2 are mounted on the lower part of a landing 72 of the stair leading to the passageway 70 in such a manner that vertical dip angles 11-1 and 11-2 of their optical axes are suitably adjustable. The rails are extended into the floor of the mill which is covered by the travel of the overhead travelling crane 50 to run in parallel with the direction of movement of the crane and ladle cars 74 and 76 carrying thereon the molten iron ladles 66 and 68 are moved on the rails into the desired waiting positions for lifting operations of the ladles by the crane 50. Let it be assumed that when the transfer car 58 of the crane 50 is moved into and stopped at a position above the ladle car 74 or 76 where the molten iron ladle 66 or 68 can be lifted, the vertical dip angle of the optical axis of either the projector 10-1 or 10-2 suspended from the travelling car 58 is properly adjusted so as to spotlight a trunnion 78 or 80 of the molten iron ladle 66 or 68. When the traverse car 60 is traversed into and stopped at a position above the ladle car where the molten iron ladle 66 or 68 can be lifted and the hoisting hook 62 is lowered by the hoisting device through the steel wire 64 into engagement with the trunnion 78 or 80 of the iron ladle 66 or 68, the principal portions of the engaging mechanism are spotlighted with the beam of light projected from the projector 10-1 or 10-2 and consisting of the spectrum of a specific wavelength range thus enabling the operator to ascertain the engaging operation by visual observation or distinguish the portions in the course of the operation from their surroundings. Since the projected beam of light mainly consists of the light beam spectral of the yellow and green colors, the surfaces of the illuminated members reflect a light having the compound color of the yellow and green colors which provides a maximum luminosity and thus the reflected light is positively distinguished from the emission of the radiant beam of light from the molten iron surface which mainly consists of the red color. This completely eliminates the heretofore experienced danger of the crane operator becoming faint by the dazzling brilliance from the surface of the molten iron and disabled to continue the operation.

FIG. 7 shows a plane view of the ladle cars 74 and 76 respectively carrying thereon the molten iron ladles 66 and 68 which are illuminated respectively by the spotlight projectors 10-1 and 10-2 mounted on the crane 50 as shown in FIG. 6. Namely, when the crane 50 is moved into a position above the ladle car 74 or 76 carrying thereon the molten iron ladle 66 or 68 and drawn along rails 82 and 84 and the hoisting hook 62 is engaged with the trunnion 78 or 80 of the molten iron ladle 66 and 68, the beam of light from the spotlight projector 10-1 or 10-2 illuminates the trunnion 78 or 80 with a spotlight of the area indicated by a hatched portion 86 or 88. In this case, while a molten iron surface 90 or 92 of the molten iron ladle 66 or 68 emits a radiant light beam mainly consisting of the red color, the illuminated portion or the hatched portion 86 or 88 radiates reflected light of the maximum luminosity which consists of the compound color of yellow and green, thus permitting easy distinction between them and thereby eliminating the danger of the crane operator becoming faint or being subjected to the influence of relative dazzling brilliance, irradiation, etc., and finding it difficult to continue the operation.

It will thus be seen from the foregoing that in accordance with the present invention an iron ladle lifting overhead travelling crane is enabled to furnish all by itself extremely advantageous operating surroundings in an iron works or steel mill where the lighting conditions are relatively unfavorable, even on a cloudy day when the natural lighting conditions are unfavorable or during night operations. Thus, by using the spotlight projector of this invention it is possible to completely eliminate the deficiencies of the conventional devices without requiring any expensive modification of the lighting equipment such as the improvement of the general lighting or local lighting equipment of the works or mill, but by mounting on the moving portion of the crane the spotlight projectors of the type embodying the present invention and employing a specially constructed very high pressure mercury lamp as a light source, thereby improving the efficiency of the molten iron ladle lifting and moving operations and considerably contributing to the operating safety. Thus, the present invention has a very great industrial utility value.

What is claimed is:

1. A transportation arrangement for illuminating trunnions of a molten iron, ladle, comprising: a bridge girder mounted on rails at a right angle with said rails; said rails being constructed underneath a ceiling of a building in longitudinal direction; a car arranged on said bridge girder for freely traversing thereon; a hoisting device for hoisting a load and having a hoisting hook and wire mounted on said traversing car; an operating room installed underneath said bridge girder; a plurality of spotlight projectors rotatably disposed in said operating room projecting a bundle of parallel light beams; a ladle car movable on rails constructed on the floor of the building for travelling in a direction of movement of said bridge girder; and a molten iron ladle positionable on said ladle car and having trunnions for engagement with the hoisting hook of said hoisting device;

wherein the improvement comprises, said spotlight projectors having means for emanating green and yellow bright-line spectra occupying a majority of said parallel light beams to the trunnions of said molten iron ladle, whereby said trunnions are engaged by said hook and are clearly discriminated by directing said light beams from said spotlight projectors in a direction of said trunnions of said molten iron ladle during the presence of radiant rays from the molten iron.

2. A transportation arrangement as defined in claim 1, wherein said spotlight projectors dispense a source of light and are defined by, a very high pressure mercury lamp; and elliptic reflecting mirror for reflecting the beam of light from said very high pressure mercury lamp; a slit arranged at a focal point for said elliptic reflecting mirror; a convex lens arranged to have the focal point of said elliptic reflecting mirror as a common focal point; and a filter arranged in the rear of said convex lens for obstructing a transmission of a wavelength range shorter than 4,500 Å.

* * * * *